US010794135B2

(12) United States Patent
Campbell et al.

(10) Patent No.: US 10,794,135 B2
(45) Date of Patent: Oct. 6, 2020

(54) DIFFERENTIAL PRESSURE ACTUATION TOOL AND METHOD OF USE

(71) Applicant: Charles Abernethy Anderson, Millarville (CA)

(72) Inventors: Joshua Reid Campbell, Calgary (CA); Christian Fay, Calgary (CA)

(73) Assignee: Charles Abernethy Anderson, Millarville (CA)

( * ) Notice: Subject to any disclaimer, the term of this patent is extended or adjusted under 35 U.S.C. 154(b) by 206 days.

(21) Appl. No.: 15/944,305

(22) Filed: Apr. 3, 2018

(65) Prior Publication Data

US 2018/0283122 A1 Oct. 4, 2018

Related U.S. Application Data

(60) Provisional application No. 62/480,751, filed on Apr. 3, 2017.

(51) Int. Cl.

| | |
|---|---|
| ***E21B 21/10*** | (2006.01) |
| ***E21B 31/00*** | (2006.01) |
| *E21B 29/00* | (2006.01) |
| *E21B 7/24* | (2006.01) |

(52) U.S. Cl.

CPC ..... *E21B 31/005* (2013.01); *E21B 7/24* (2013.01); *E21B 21/10* (2013.01); *E21B 29/00* (2013.01)

(58) Field of Classification Search

CPC ..... E21B 34/08; E21B 21/10; E21B 31/005; E21B 29/00; E21B 7/24; E21B 47/187; E21B 2034/007; E21B 28/00; Y10T 137/87499; Y10T 137/3367; Y10T 137/87539

See application file for complete search history.

(56) References Cited

U.S. PATENT DOCUMENTS

| | | | | | |
|---|---|---|---|---|---|
| 2,121,936 | A * | 6/1938 | Thomas | F16K 17/26 | 137/498 |
| 2,765,146 | A * | 10/1956 | Williams, Jr. | E21B 21/10 | 175/317 |
| 3,958,217 | A * | 5/1976 | Spinnler | E21B 47/18 | 367/83 |
| 3,974,876 | A | 8/1976 | Taylor | | |
| 4,174,731 | A * | 11/1979 | Sturgis | F16K 17/26 | 137/498 |
| 4,403,659 | A * | 9/1983 | Upchurch | E21B 34/10 | 166/321 |
| 4,519,574 | A * | 5/1985 | Roper | E21B 21/10 | 251/31 |

(Continued)

*Primary Examiner* — Steven A MacDonald

(74) *Attorney, Agent, or Firm* — Holzer Patel Drennan

(57) ABSTRACT

An improved downhole tool for use in wellbores. In some embodiments, the tool has a first position wherein fluids entering the tool can exit via two or more flow passages, and a second position wherein some of the two or more flow passages are blocked such that fluids in the tool exit via the remaining unblocked flow passages. In other embodiments, the tool has a first position wherein fluids entering the tool are directed to some of the two or more flow passages, and a second position wherein fluids entering the tool are directed to the remaining flow passages. The tool is transitionable between the first and second positions by alternately ceasing or decreasing fluid flow to the tool and introducing or increasing fluid flow to the tool.

17 Claims, 12 Drawing Sheets

(56) References Cited

U.S. PATENT DOCUMENTS 4,749,044 A * 6/1988 Skipper ..... E21B 34/102 166/301
4,821,817 A * 4/1989 Cendre ..... E21B 17/1014 175/269
4,905,778 A * 3/1990 Jurgens ..... E21B 47/187 166/320
5,022,426 A * 6/1991 Fischer ..... F16K 31/36 137/119.03
5,265,643 A * 11/1993 Golestan ..... G05D 7/0133 137/504
5,383,489 A * 1/1995 Golestan ..... G05D 7/0133 137/504
5,437,308 A * 8/1995 Morin ..... E21B 7/068 138/46
5,443,129 A * 8/1995 Bailey ..... E21B 7/061 175/45
5,609,178 A * 3/1997 Hennig ..... E21B 23/006 137/10
5,957,197 A * 9/1999 Xia ..... E21B 21/10 137/517
6,095,249 A * 8/2000 McGarian ..... E21B 21/002 166/319
6,109,354 A * 8/2000 Ringgenberg ..... E21B 23/006 166/374
6,173,795 B1 * 1/2001 McGarian ..... E21B 23/006 175/231
6,176,327 B1 * 1/2001 Hearn ..... E21B 21/103 175/38
6,196,259 B1 * 3/2001 Weber ..... G05D 7/0133 137/504
6,237,701 B1 * 5/2001 Kolle ..... E21B 7/18 175/1
6,378,612 B1 * 4/2002 Churchill ..... E21B 21/103 166/319
6,543,532 B2 * 4/2003 Estep ..... E21B 34/066 166/66.4
6,820,697 B1 * 11/2004 Churchill ..... E21B 21/103 166/374
7,139,219 B2 * 11/2006 Kolle ..... E21B 47/14 367/85
7,281,584 B2 * 10/2007 McGarian ..... E21B 21/103 166/169
7,299,880 B2 * 11/2007 Logiudice ..... E21B 21/103 166/381
7,430,153 B2 9/2008 Fraser
7,584,801 B2 * 9/2009 deBoer ..... E21B 21/10 166/386
7,766,084 B2 * 8/2010 Churchill ..... E21B 21/103 166/320
8,186,440 B2 * 5/2012 Tveiten ..... E21B 43/013 166/344
8,215,403 B1 * 7/2012 Penisson ..... E21B 23/006 166/321
8,336,627 B2 * 12/2012 Patel ..... E21B 23/03 166/167
8,607,811 B2 * 12/2013 Korkmaz ..... E21B 23/006 137/508
8,739,864 B2 * 6/2014 Crider ..... E21B 34/14 166/240
8,960,333 B2 * 2/2015 Radford ..... E21B 10/322 175/268
9,222,312 B2 * 12/2015 Anderson ..... E21B 7/24
9,279,300 B2 3/2016 Kolle
9,494,014 B1 * 11/2016 Manke ..... E21B 21/103
9,540,905 B2 * 1/2017 Woodford ..... E21B 34/08
10,316,647 B2 * 6/2019 Renshaw ..... E21B 47/185
10,352,130 B2 * 7/2019 Tolman ..... E21B 43/02
2003/0136563 A1 * 7/2003 Allamon ..... E21B 21/08 166/386
2005/0173125 A1 * 8/2005 Naquin ..... E21B 21/10 166/373
2007/0181188 A1 * 8/2007 Branch ..... E21B 21/10 137/494
2009/0211814 A1 * 8/2009 de Boer ..... E21B 21/10 175/57
2011/0168410 A1 * 7/2011 deBoer ..... E21B 21/10 166/386
2012/0090856 A1 * 4/2012 Rogers ..... E21B 47/024 166/386
2012/0181044 A1 * 7/2012 Nikiforuk ..... E21B 7/20 166/374
2012/0273271 A1 * 11/2012 Stuart-Bruges ..... E21B 47/187 175/38
2012/0327742 A1 * 12/2012 Kusko ..... G01V 1/137 367/25
2013/0133878 A1 * 5/2013 Urban ..... E21B 21/103 166/194
2014/0231094 A1 * 8/2014 Greci ..... E21B 43/12 166/373
2014/0345705 A1 * 11/2014 Grande ..... E21B 23/006 137/68.17
2015/0114716 A1 * 4/2015 Yang ..... E21B 7/24 175/56
2018/0045003 A1 * 2/2018 Evans ..... E21B 21/10
2019/0360308 A1 * 11/2019 Stang ..... E21B 41/0078

* cited by examiner

DIFFERENTIAL PRESSURE ACTUATION TOOL AND METHOD OF USE

CROSS REFERENCES

This Application claims priority to U.S. Provisional Patent Application No. 62/480,751, entitled "Differential Pressure Actuator and Method of Use", filed Apr. 3, 2017, which is hereby incorporated by reference in its entirety.

FIELD

Embodiments disclosed herein generally relate to downhole tools for use in wellbores, and more specifically to the use of downhole agitation tools used to aid in progressing downhole milling operations within the wellbore.

BACKGROUND

In the drilling and reworking of wellbores in the oil and gas industry, downhole tools known as packers or plugs are commonly used to temporarily seal the wellbore, and then removed from the wellbore such that operations can continue. Although the packers or plugs could potentially be retrieved, it is often simpler and less expensive to mill or drill the tools from the wellbore. Such processes, however, are relatively slow, particularly where one or more plugs need to be removed and there are significant distances traveled by the milling tools in between the plugs.

It is also difficult to extend milling tools long distances down a wellbore in order to reach plugs positioned deep within the wellbore. By way of example, where it can only take a few minutes to mill a plug, it can take a few hours to move the milling tool between the plugs. Unfortunately, mill times and travel times tend to increase over the course of the well.

There is a need for improved milling process, such processes operative to reduce travel time in between milling and/or drilling operations for removing downhole packers and plugs.

SUMMARY

According to a broad aspect of the present disclosure, there is provided a tool connectable to a tubing string for enhancing agitation of a downhole apparatus, the tool comprising: a housing having an axial bore extending therethrough between a housing inlet and a housing outlet, and two or more flow passages defined therein uphole from the housing outlet; and a piston movable in the bore of the housing between a first position and a second position, the piston having an axial bore extending therethrough between a piston inlet and a piston outlet, the piston inlet being in fluid communication with the bore of the housing, and in the first position, the bore of the piston is in fluid communication with the two or more flow passages via the piston outlet; and in the second position, the piston blocks fluid communication to at least one of the two or more flow passages, and the bore of the piston is only in fluid communication with the remainder of the two or more flow passages via the piston outlet, wherein the piston is transitionable between the first and second positions by alternately introducing or increasing fluid flow to the housing via the housing inlet and ceasing or decreasing the fluid flow to the housing via the housing inlet, and wherein the fluid flow flows through at least some of the flow passages before exiting the tool.

According to another broad aspect of the present disclosure, there is provided a method of enhancing agitation of a downhole apparatus on a tubing string, the method comprising: providing a tool on the tubing string near the downhole apparatus, the tool comprising a housing having an axial bore extending between a housing inlet and a housing outlet and two or more flow passages defined therein; and a piston movable in the housing between a first position and a second position, the piston having an axial bore between a piston inlet and a piston outlet, the piston inlet being in fluid communication with the bore of the housing; introducing or increasing fluid flow to the housing via the housing inlet to move the piston axially in a direction to place the piston in the first or second position, wherein in the first position, the bore of the piston is in fluid communication with the two or more flow passages via the piston outlet; and in the second position, the piston blocks fluid communication to at least one of the two or more flow passages, and the bore of the piston is only in fluid communication with the remainder of the two or more flow passages via the piston outlet; ceasing or decreasing the fluid flow to the housing to move the piston axially in a second direction opposite to the first direction; introducing or increasing the fluid flow to the housing via the housing inlet to move the piston axially to transition the piston from the first position to the second position or from the second position to the first position.

According to yet another broad aspect of the present disclosure, there is provided a tool connectable to a tubing string, the tool comprising: a housing having an axial bore extending therethrough between a housing inlet and a housing outlet, and a first flow passage and a second flow passage defined therein uphole from the housing outlet; and a piston movable in the bore of the housing between a first position and a second position, the piston having an axial piston bore, a piston inlet, and a piston outlet, the piston bore being in fluid communication with the bore of the housing via the piston inlet, and in the first position, the piston blocks fluid communication to the second flow passage and the piston bore is in fluid communication with the first flow passage via the piston outlet; and in the second position, the piston blocks fluid communication to the first flow passage and the piston bore is in fluid communication with the second flow passage via the piston outlet, wherein the piston is transitionable between the first and second positions by alternately introducing or increasing fluid flow to the housing via the housing inlet and ceasing or decreasing the fluid flow to the housing via the housing inlet, and wherein in the first position the fluid flow flows through the first flow passage before exiting the tool, and wherein in the second position the fluid flow flows through the second flow passage before exiting the tool.

According to another broad aspect of the present disclosure, there is provided a method comprising: providing a tool on a tubing string, the tool comprising a housing having an axial bore extending between a housing inlet and a housing outlet and a first flow passage and second flow passage defined therein; and a piston movable in the housing between a first position and a second position, the piston having a piston bore, a piston inlet, and a piston outlet, the piston bore being in fluid communication with the bore of the housing via the piston inlet; introducing or increasing fluid flow to the housing via the housing inlet to move the piston axially in a direction to place the piston in the first or second position, wherein in the first position, the piston blocks fluid communication to the second flow passage and the piston bore is in fluid communication with the first flow passage via the piston outlet; and in the second position, the piston blocks fluid communication to the first flow passage and the piston bore is in fluid communication with the second flow passage via the piston outlet; ceasing or decreasing the fluid flow to the housing to move the piston axially in a second direction opposite to the first direction; introducing or increasing the fluid flow to the housing via the housing inlet to move the piston axially to transition the piston from the first position to the second position or from the second position to the first position.

DESCRIPTION OF THE DRAWINGS

The invention will now be described by way of an exemplary embodiment with reference to the accompanying simplified, diagrammatic, not-to-scale drawings. Any dimensions provided in the drawings are provided only for illustrative purposes, and do not limit the invention as defined by the claims. In the drawings:

FIGS. 3A and 3B are sometimes collectively referred to herein as FIG. 3;

FIGS. 4A and 4B are sometimes collectively referred to herein as FIG. 4;

FIGS. 5A and 5B are sometimes collectively referred to herein as FIG. 5;

FIGS. 6A and 6B are sometimes collectively referred to herein as FIG. 6.

FIGS. 8A and 8B are sometimes collectively referred to herein as FIG. 8;

FIGS. 9A and 9B are sometimes collectively referred to herein as FIG. 9; FIGS. 10A and 10B are sometimes collectively referred to herein as FIG. 10.

DESCRIPTION OF EMBODIMENTS

Figure 1:
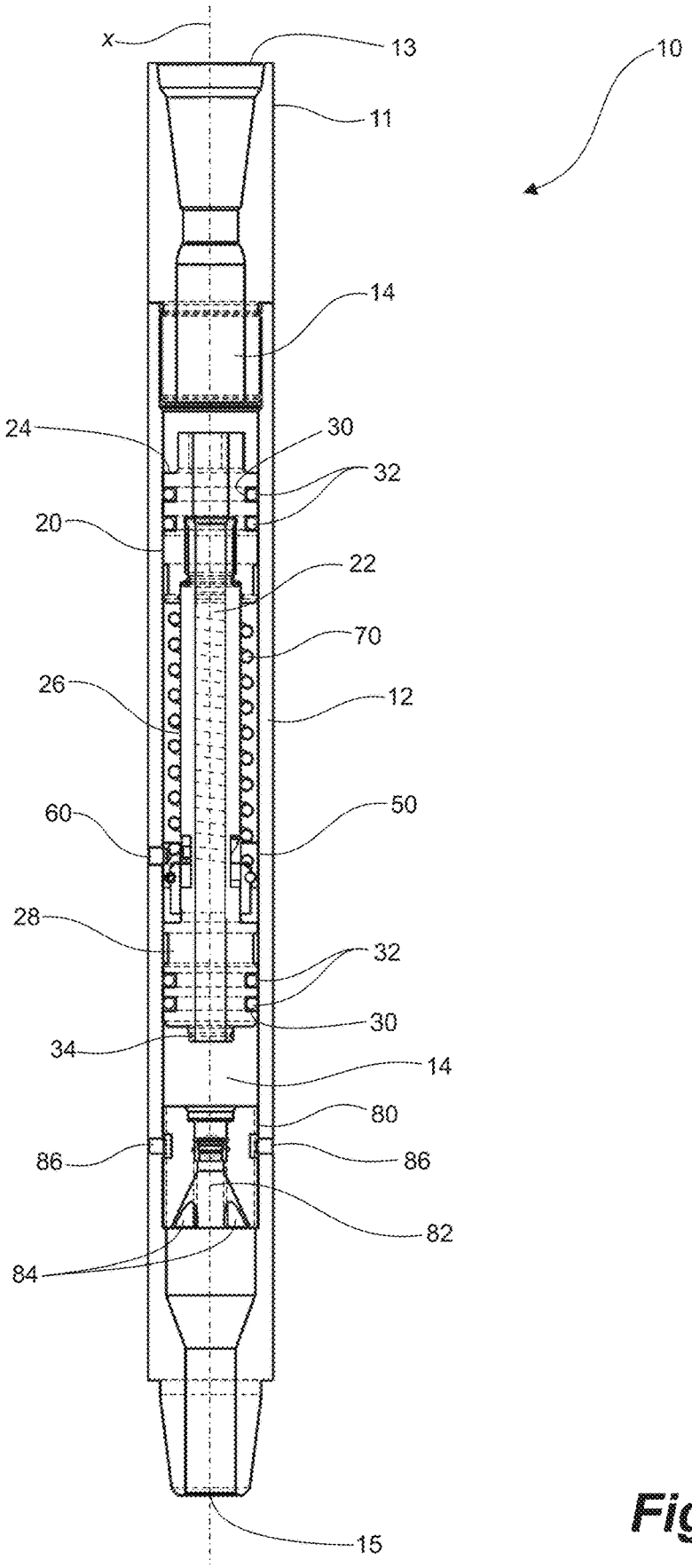
FIG. 1 is a cross sectional side view of the present tool according to one embodiment herein, the tool shown in a first (low pressure) position.

When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

According to embodiments herein, improved apparatus and methodologies for improving milling times of downhole packers, plugs, or the like are provided.

By way of background, many tools for inducing movement of a downhole apparatus are known, and are collecting referred to herein as 'agitator' tools. Some such agitator tools include Applicant's own technology disclosed in U.S. Pat. No. 9,222,312, incorporated herein in its entirety by reference, which uses a variable restrictor in the fluid flow to vent a small amount of fluid from the tool to the annulus, reducing the pressure within the tool and creating a negative pressure pulse (i.e. an axial mechanical force, or a fluid hammer effect). The fluid hammer effect generates hydraulic inertial forces that produce an impact energy pulse, improving the overall weight transfer of the tool. Such tools can reduce static friction (i.e. drag) within the wellbore and enable more efficient transfer of weight onto the bit. When used in milling operations, such tools advantageously achieve substantially consistent mill times along the length of the wellbore. It is believed that such advantages are at least partially the result of the variable restriction in the fluid flow and also the periodic venting of the built-up differential pressure (created by the milling motor) between the agitator tool/tubing string and the annulus. However, because the milling motor is not in operation when the downhole tools (e.g. tubing string) are travelling between plugs, no differential pressure is created. There is a need for a downhole tool operative to generate a differential pressure substantially similar to the differential pressure typically generated by the milling motor, thereby serving to achieve the above-referenced advantages when the milling motor is turned off.

A pressure actuation tool 10 is provided herein for selectively providing a differential pressure between the tubing string and the annulus in a zone at or above the tool, so as to facilitate more effective operation of an agitation tool located uphole therefrom and/or to function as a stand-alone agitation tool. According to embodiments herein, the present tool may be configured as a sub adapted at its upper (uphole) and lower (downhole) ends to be incorporated into any drilling fluid transmitting downhole tubulars positioned within a subterranean wellbore including, without limitation, drill string, coil tubing, casing string, etc., collectively referred to herein as tubing strings. Tool 10 may be utilized to agitate the downhole tubulars, and may operate alone or in combination with other downhole tools such as vibration or agitation tools, milling tools, hammer subs, etc.

Figure 2:
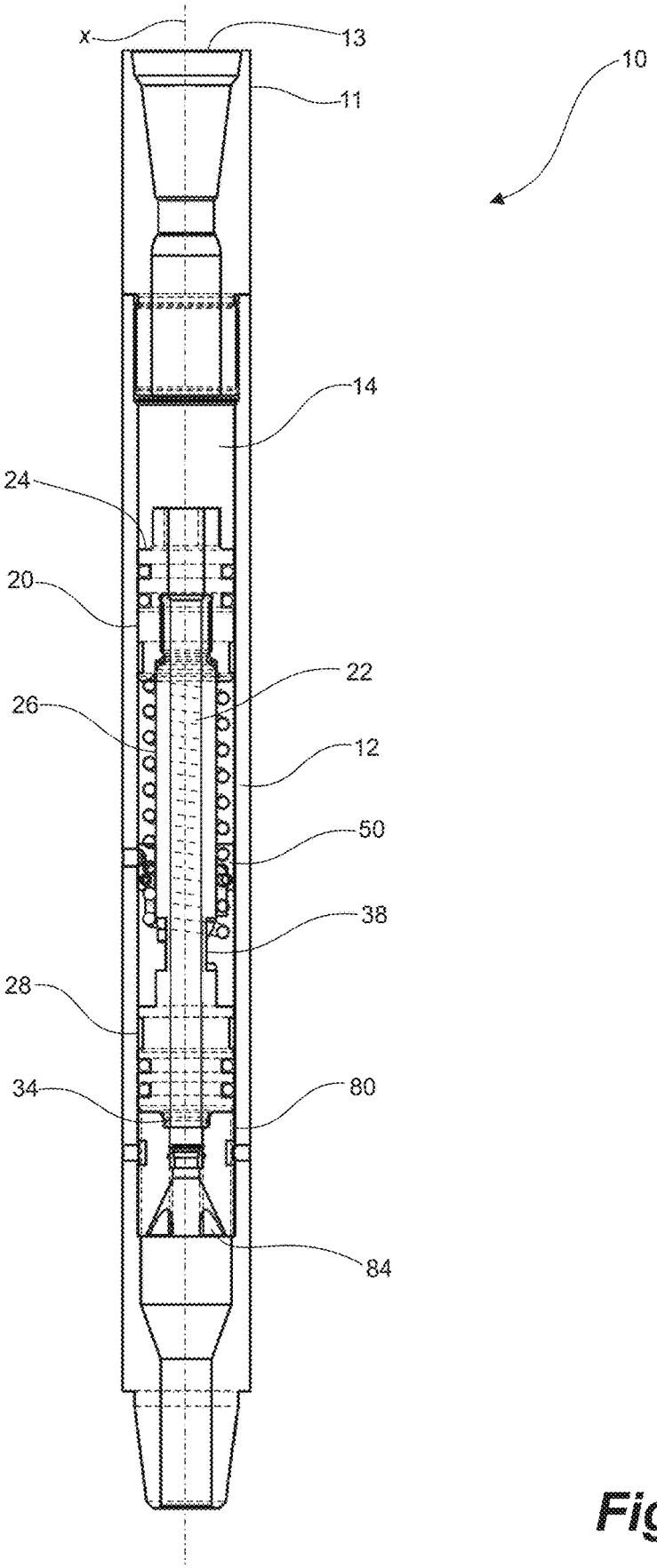
FIG. 2 is a cross sectional side view of the present tool according to one embodiment herein, the tool shown in a second (high pressure) position.
Figure 3A:
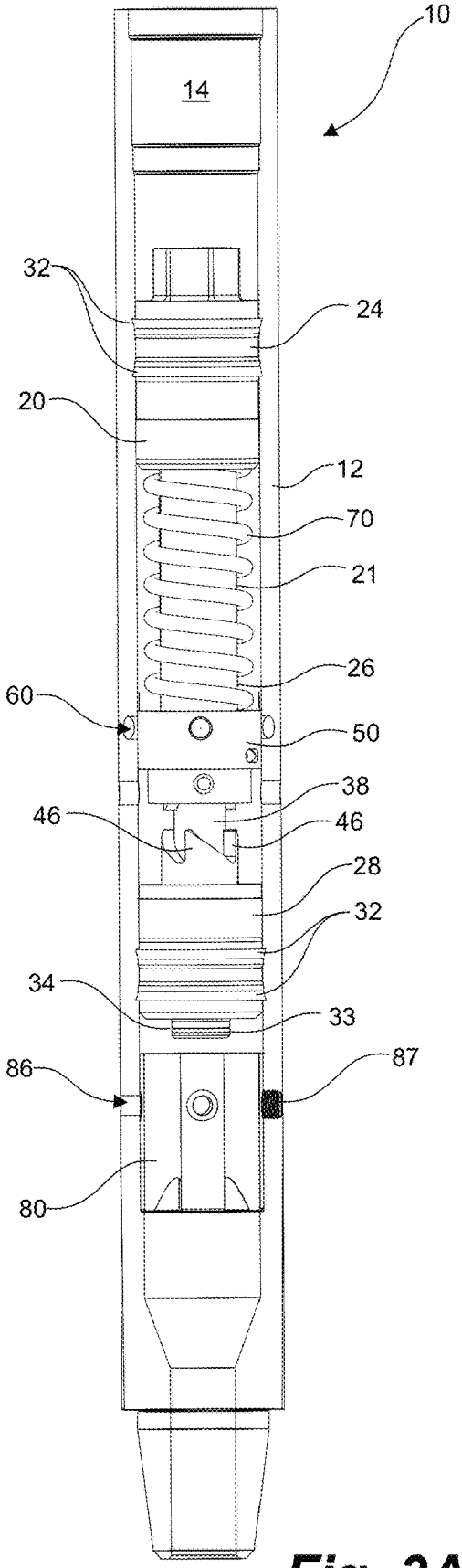
FIGS. 3A and 3B are a first side view and a second side view, respectively, of the present tool according to embodiments herein, with the top portion omitted and the housing shown in cross-section, and the tool being shown in the first (low pressure) position.
Figure 3B:
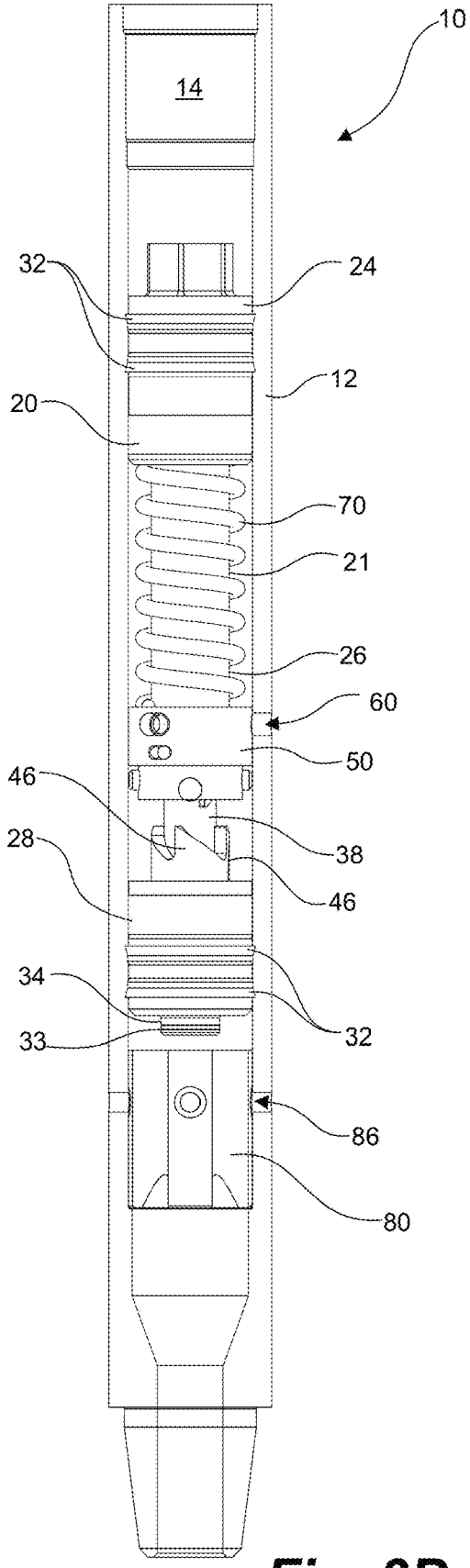
Figure 4A:
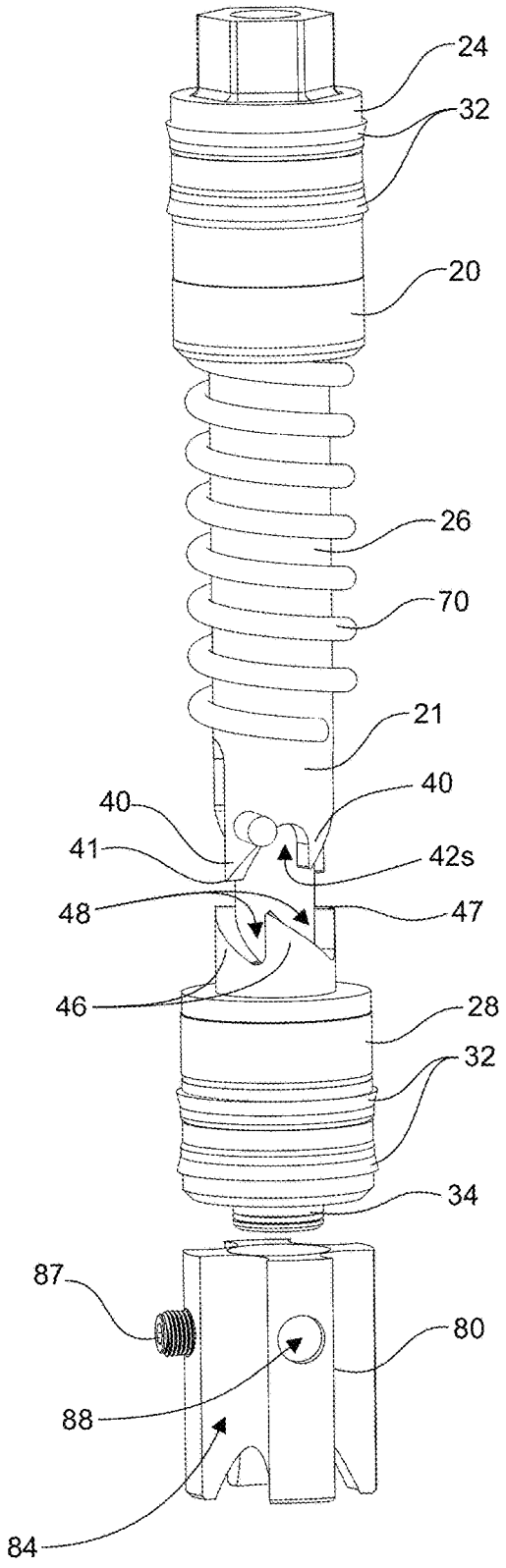
FIGS. 4A and 4B are a first perspective view and a second perspective view, respectively, of the tool depicted in FIG. 3, with the housing and the bearing assembly omitted.
Figure 4B:
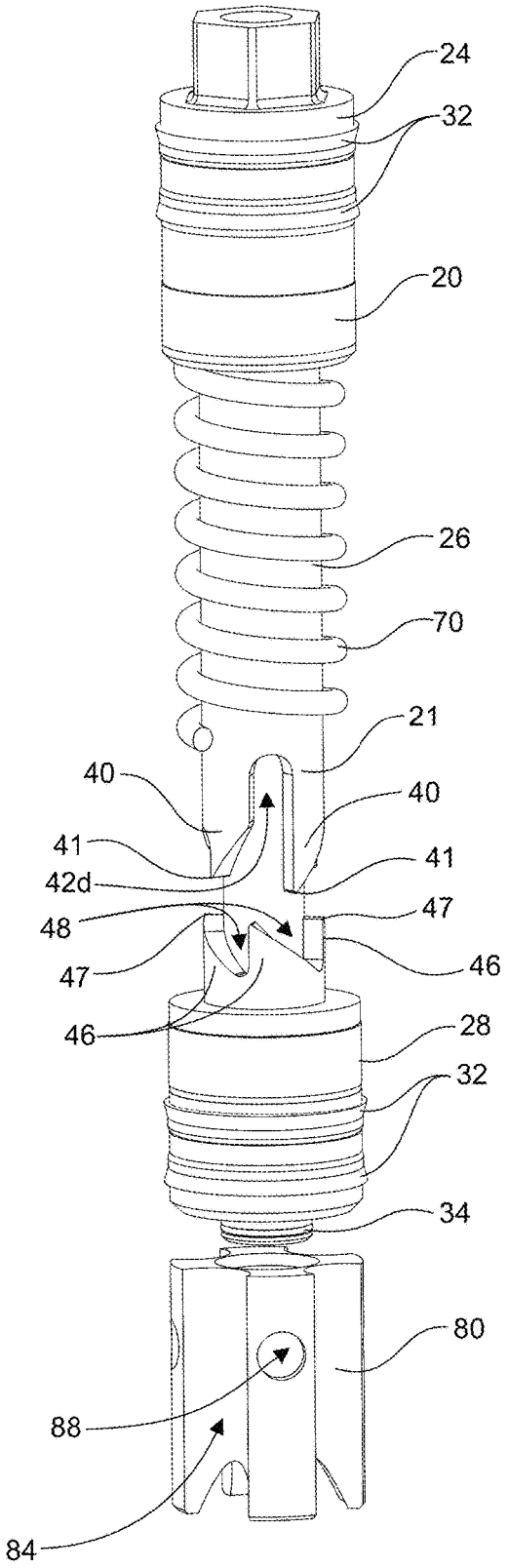
Figure 5A:
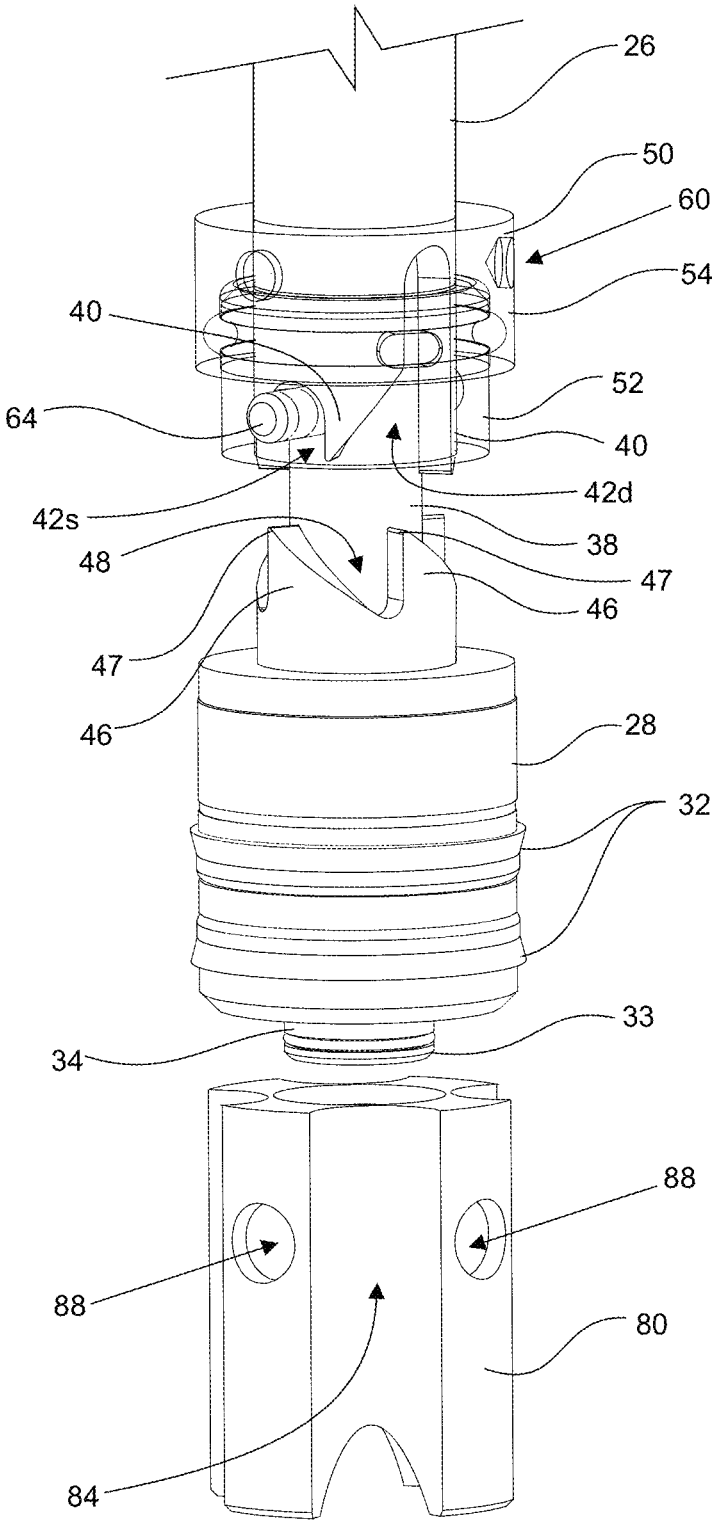
FIGS. 5A and 5B are a first zoomed in perspective view and a second zoomed in perspective view, respectively, of the tool depicted in FIG. 3, with the housing omitted and the bearing assembly shown in phantom lines.
Figure 5B:
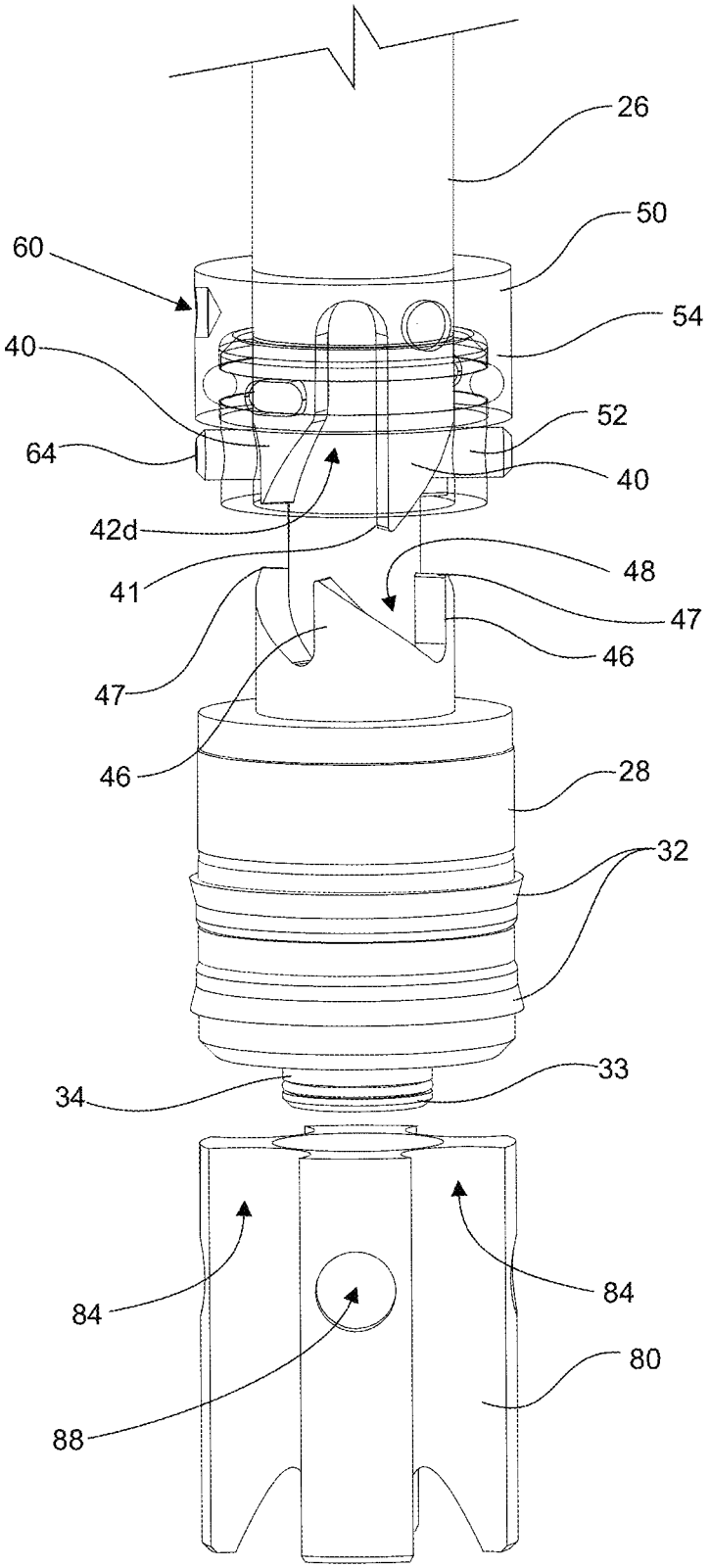

Having regard to FIGS. 1 and 2, sub 10 comprises a tubular housing 12 having a longitudinal bore 14 extending therethrough for transmitting drilling fluid through the downhole tubulars. The bore 14 has a central axis x, an upper (uphole) inlet end 13, and a lower (downhole) outlet end 15. Inlet and outlet ends 13,15 can include interior or exterior threading, or other such connection means known in the art, for connecting the housing 12 to the downhole tubulars (not shown). Connections may be of conventional type, such as pin/box type to facilitate ready connection with the downhole tubulars. Housing 12 may be of steel construction, or any other suitable material, and can be surface hardened for durability and abrasion resistance.

Housing 12 is configured to receive a reciprocating valve 20 in bore 14. Valve 20 is a hydraulically actuated piston, reciprocated between a first, low-pressure position (FIG. 1) and a second, high-pressure position (FIG. 2), as described in more detail below. Valve 20 may also be referred to herein as a piston. Positioning of the valve 20 in the first or second position may be selectively controlled by adjusting the fluid flow into bore 14, which may be accomplished using pumps (not shown) to transmit drilling fluids through bore 14 at varying rates.

In the illustrated embodiment, valve 20 comprises a generally cylindrical tubular body 21 that is axially movable within bore 14 of housing 12. Body 21 has a valve bore 22 extending axially therethrough and in fluid communication with bore 14. Body 21 has an upper portion 24 and a lower portion 28, having outer diameters substantially equal to or smaller than the inner diameter of bore 14. Valve 20 can thus freely reciprocate axially within bore 14.

The outer surface of upper and lower portions 24,28 of body 21 is configured to provide annular grooves 30 for seating annular seals 32, such as annular O-rings or other seals known in the art. When seated in grooves 30, seals 32 sealingly engage the inner surface of bore 14, thereby preventing fluid flow therebetween. It is contemplated that upper portion 24 may be a discrete member from the portions of valve 20 therebelow. In alternative embodiments, upper portion 24 may be integral with the portions of valve 20 therebelow.

Valve 20 has a valve plug 34 extending axially from the lower end of lower portion 28. Plug 34 has an axially extending plug bore 35 defined therein, in fluid communication with bore 22 for expelling fluid flowing through bores 14,22 from the lower end of lower portion 28. In some embodiments, bore 35 may have an inner diameter that is substantially equal to that of bore 22. The outer diameter of plug 34 may be substantially smaller than the outer diameter of lower portion 28, such that plug 34 can correspondingly engage a valve seat 80 therebelow (described in more detail below). The outer surface of the plug 34 may be configured to have plug grooves 31 for seating annular plug seals 33, such that plug 34 sealingly engages seat 80 to prevent fluid flow through the tool 10 (See FIGS. 2 and 6B).

Body 21 has a middle portion 26 having an outer diameter substantially smaller than the inner diameter of bore 14 and the outer diameter of upper and lower portions 24,28. The outer surface of middle portion 26 has defined thereon a cam actuation area 38 which comprises an annular teeth forming groove for guiding axial and rotational movement of valve 20. More specifically, as will be described in more detail, cam actuation area 38 serves to rotate valve 20 by an angle about the central axis upon each axial reciprocation of the valve 20 within bore 14. In some embodiments, valve 20 may further comprise an annular bearing assembly 50 and a spring 70, supported on the outer surface of middle portion 26.

According to embodiments herein and with reference to FIGS. 1 to 6, the annular groove in the cam actuation area 38 defines a plurality of corresponding upper teeth 40 and lower teeth 46, radially intermittently positioned around the outer surface of the middle portion 26. Each upper tooth 40 is an apex portion having a peak 41. The upper teeth 40 are separated by alternating deep and shallow slots 42*d*, 42*s*. The depth of the slots 42*d*, 42*s* is the length between the peak 41 of the tooth and the trough of the slot 42*d*, 42*s*. The deep slots 42*d* have a larger depth than the shallow slots 42*s* and thus extend further towards upper portion 24 (i.e. in an uphole direction) than shallow slots 42*s*.

Both the deep and shallow slots 42*d*,42*s* are sized for slidably receiving a cam 64 therein. It should be understood by a skilled person that the depth of both deep and shallow slots 42*d*,42*s* may be predetermined and selected as desired based upon the distance of the valve 20 from valve seat 80, such that the receipt of cam 64 in the deep slots 42*d* enables valve 20 to extend sufficiently downwardly for plug 34 to sealingly engage with valve seat 80 therebelow, whereas the receipt of cam 64 in the shallow slots 42*s* may prevent same (as described in more detail below).

Each lower tooth 46 is an apex portion having a peak 47. Adjacent lower teeth 46 are separated by a valley 48. The upper and lower teeth 40,46 can be oriented such that the peaks 41 are radially aligned with the valleys 48, and the peaks 47 are radially aligned with the slots 42*d*, 42*s*. The peaks, slots, and valleys are directional (i.e. asymmetrical) and shaped to alternatingly advance cam 64 to the next set of slots 42*d*,42*s* and valleys 48 as valve 20 is reciprocated axially inside bore 14 of housing 12. In some embodiments, teeth 40 and/or teeth 46 each have an angled profile that is shaped as a cam guide.

While the valve 20 in the illustrated embodiment has four upper teeth 40 and four lower teeth 46, the valve 20 may have fewer or more upper and lower teeth in other embodiments.

With reference to FIGS. 1 to 3 and 7, bearing assembly 50 is positioned inside housing 12 between the upper end 24 and lower end 26 of valve 20. As best shown in FIGS. 6, 8, and 9, bearing assembly 50 comprises an annular member 51 having a rotatable inner ring 52 and a stationary outer ring 54. A lower portion of the outer ring 54 is configured to slidably receive at least an upper portion of inner ring 52 in a coaxially overlapping manner, while a least a lower portion of inner ring 52 extends downwardly from the lower end of the outer ring 54. When the upper portion of inner ring 52 is received in the lower portion of outer ring 54, an annular channel 57 is defined between the inner and outer rings 52, 54. The channel 57 is configured to receive and support a plurality of ball bearings 58 therein. As would be understood, bearing assembly 50 may be secured to housing 12 via any appropriate securing means known in the art such as, for example, via bolts threaded through apertures 60 in housing 12 and, at least partially, through corresponding apertures 61 in outer ring 54.

In some embodiments, outer ring 54 has an internal annular recess 53 for slidably receiving inner ring 52. As such, outer ring 54 may be adapted to have a smaller internal diameter at its upper (uphole) portion versus it lower (downhole) portion, the difference in internal diameters thereby defining the annular recess 53 with an annular shoulder 56. When inner ring 52 is slidably received within outer ring 54, the upper (uphole) end of inner ring 52 is adjacent to and may be in abutment with shoulder 56. The lower portion of inner ring 52 extending axially downwardly from outer ring 54 has at least one cam 64 protruding radially therefrom. In some embodiments, cam 64 is a substantially cylindrical member positioned at a radial location of the inner ring 52 and extends radially inwardly from the inner surface of the inner ring 52 into the cam actuation area 38. Cam 64 is sized and shaped to correspondingly engage slots 42*d*,42*s* and valleys 48. In some embodiments, cam 64 may be provided in inner ring 52 by inserting an elongated substantially cylindrical member through a radially positioned hole in inner ring 52 such that an axial portion of the member extends radially inwardly from the inner surface of the inner ring 52. The elongated member may be secured to the inner ring 52 by welding or other methods known in the art.

In some embodiments, the positions of the cam and the upper and lower teeth, slots, and valleys may be reversed such that the cam is on the outer surface of the valve 20, extending radially outwardly therefrom, while the upper and lower teeth, slots, and valleys are defined on the inner surface of the bearing assembly.

While the outer ring 54 has the internal annular recess 53 in the illustrated embodiment, other configurations are possible. For example, the inner ring 52 may have an external annular recess for receiving an axial portion of the outer ring 54, or both the inner and outer rings 52,54 may have corresponding annular recesses on their outer and inner surfaces, respectively, for receiving an axial portion of one another.

Figure 7:
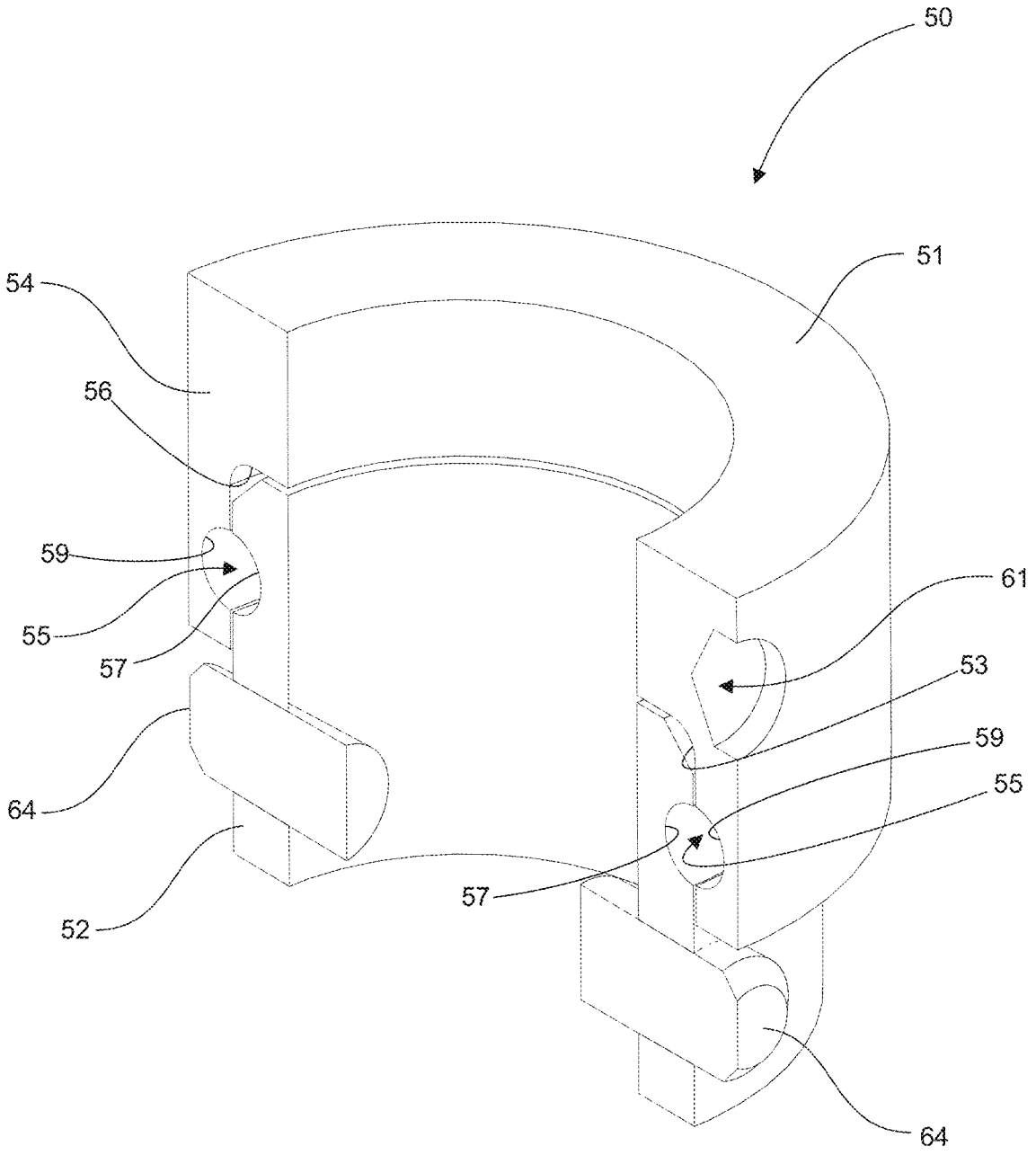
FIG. 7 is a cross sectional perspective view of a bearing assembly of the present tool.
Figure 8A:
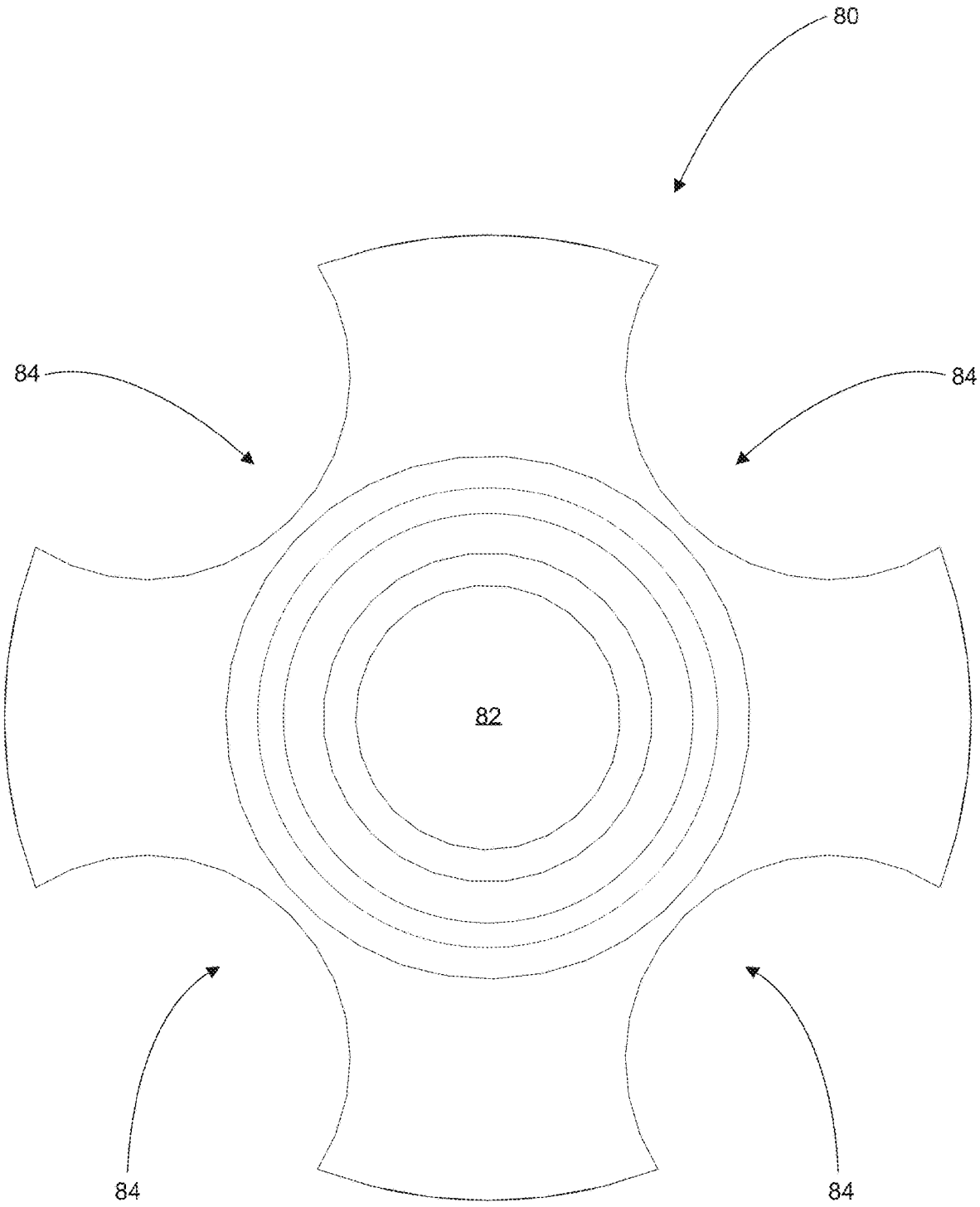
FIGS. 8A and 8B are a top view and a cross sectional perspective view, respectively, of a valve seat of the present tool according to embodiments herein.
Figure 8B:
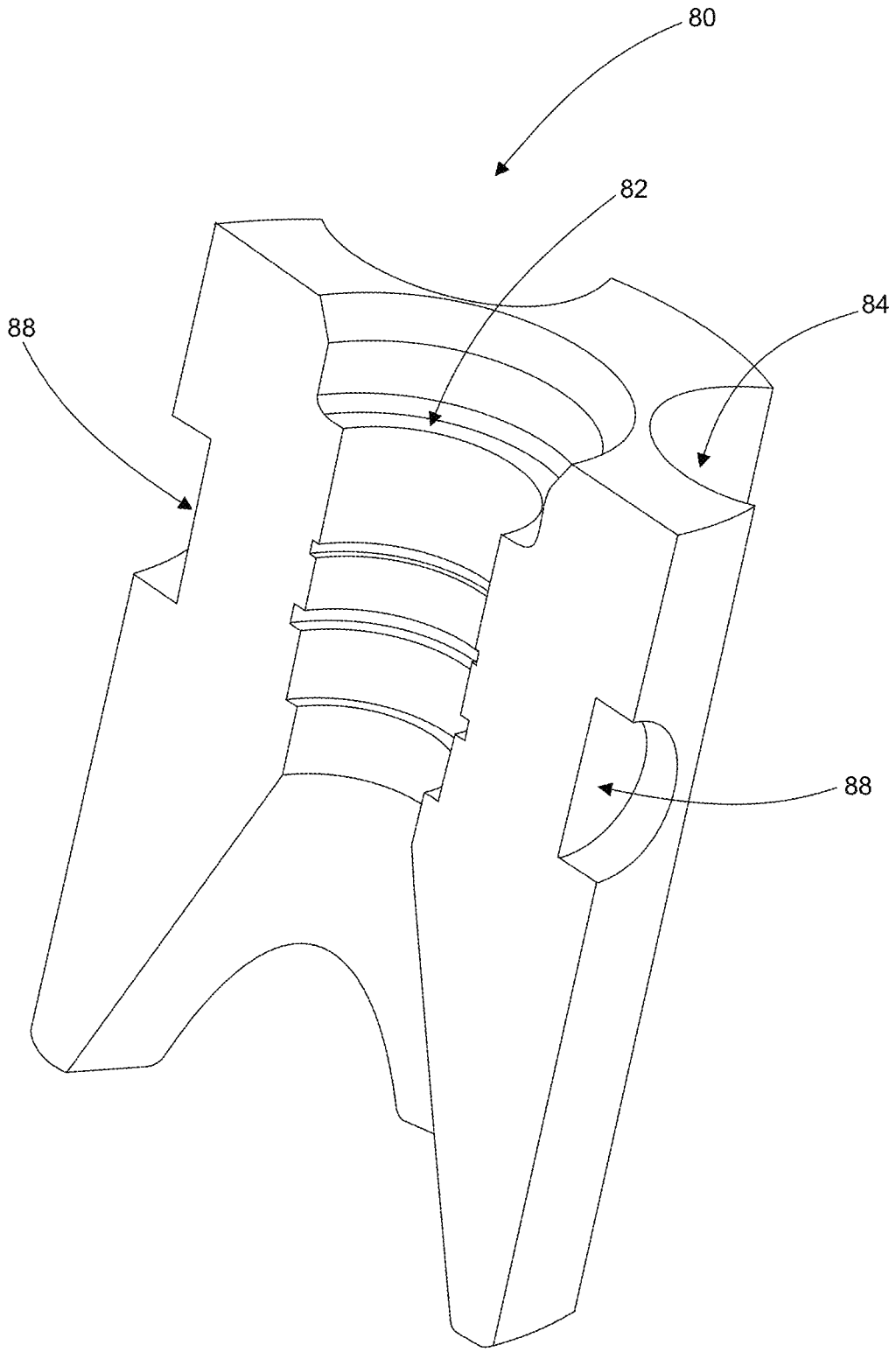

Having specific regard to FIG. 7, inner ring 52 has an annular groove 57 on its outer surface and outer ring 54 has an annular groove 59 on its inner surface that corresponds to the annular groove 57. When aligned, the annular grooves 57,59 together form a circumferential channel 55 for receiving and containing the plurality of ball bearings 58 therein. As would be understood, channel 55 may be appropriately sized to enable inner ring 52 to freely rotate about central axis x, while outer ring 54 remains stationary (and securely affixed to housing 12).

Returning to FIGS. 1 to 6, spring 70 encompasses middle portion 26, between upper and lower portions 24,28. It should be understood that spring 70 may be positioned in abutting relationship with bearing assembly 50, and more specifically may be positioned to rest on the upper surface of annular member 51. As such, valve 20 may be spring-biased in an upward direction, such that when the spring 70 is compressed, it exerts an upward force on valve 20 (i.e. away from valve seat 80). As would be known, the configuration of spring 70 may be selected based upon a predetermined size and the desired compression/tension. When no external force is applied on valve 20, spring 70 may be configured such that the cam 64 is positioned within one of the valleys 48 of lower teeth 46. Spring 70 may have a linear or progressive spring rate.

With reference to FIGS. 1 to 5 and as best shown in FIG. 8, the present actuation tool 10 further comprises valve seat 80, positioned at or near the outlet end 15. Valve seat 80 has a central bore 82 extending therethrough and one or more circumferentially positioned passages 84 located on the outer surface thereof. In the illustrated embodiment, each passage 84 extends generally axially along the length of valve seat 80. Radial passages 84 can follow a linear, helical, or any other fluid flow path, provided that they fluidly connect the space above and below the valve seat 80. Valve seat 80 may be securely affixed to housing 12 via any appropriate means as would be known in the art. For example, a bolt 87 may be threaded through an aperture 86 in housing 12 and at least partially into a corresponding valve seat aperture 88 at a radial position on the outer surface of valve seat 80 other than the passages 84.

At its upper end, central bore 82 is sized and shaped to receive valve plug 34 so as to form a substantially fluid-tight connection therewith. According to embodiments herein, central bore 82 may have a frustoconically shaped lower end, such that the inner diameter of bore 82 increases towards the downhole end of the valve seat 80 (See FIG. 8B). The frustoconical shape of bore 82 may reduce fluid backflow (e.g. eddies) created by fluid flow through the passages 84, which may decrease the rate of erosion of the components. In alternative embodiments, valve seat 80 may be otherwise configured, such as in an opposed fashion wherein the valve seat 80 has a valve plug extending upwardly therefrom towards inlet end 13 and lower portion 28 of valve 20 is configured at to receive the valve plug therein.

In the low pressure position, as shown in FIG. 1, the central bore 82 is in fluid communication with valve bore 22 via bore 14 of the housing 12 and with the one or more passages 84 at or near the lower end of bore 82. Further, the passages 84 are also in fluid communication with valve bore 22 via bore 14. In the high pressure position, as shown in FIG. 2, only central bore 82 is in fluid communication with valve bore 22, while fluid communication with passages 84 is blocked.

According to embodiments herein, the present agitation tool 10 may be assembled as follows:

(i) with the top portion 11 uncoupled from housing 12 to permit open access to bore 14, valve seat 80 is inserted into bore 14 with its apertures 88 in alignment with corresponding apertures 86 of the housing 12 such that bolt 87 can be threaded therethrough to secure the seal seat 80 to housing 12;

(ii) valve 20 can be assembled, with upper portion 24 uncoupled from and with lower portion 28 coupled to middle portion 26, by sliding the inner and outer rings 52,54 on to the middle portion, such that the rings 52,54 encircle middle portion 26 about the cam actuation area 38. One or more cams 64 is inserted through holes in the inner ring 52 such that the cams engage one of the slots 42*s*,42*d* or valleys 48 and the cams are secured to the inner ring 52;

(iii) spring 70 slides on to the valve 20 to coil around middle portion 26 and then upper portion 24 is coupled to middle portion 26 to secure the bearing assembly 50 and spring 70 between upper and lower portions 24,26;

(iv) once assembled, valve 20 is inserted into and positioned within bore 14 above valve seat 80, until the apertures 61 of the outer ring 54 are aligned with the apertures 60 of housing 12, and then bolts are threaded through both apertures to secure the bearing assembly 50 to the housing 12; and (v) top portion 11 is then coupled at the upper end of housing 12 and the assembled tool 10 can be installed on a tool string near and/or below an agitator.

Figure 6A:
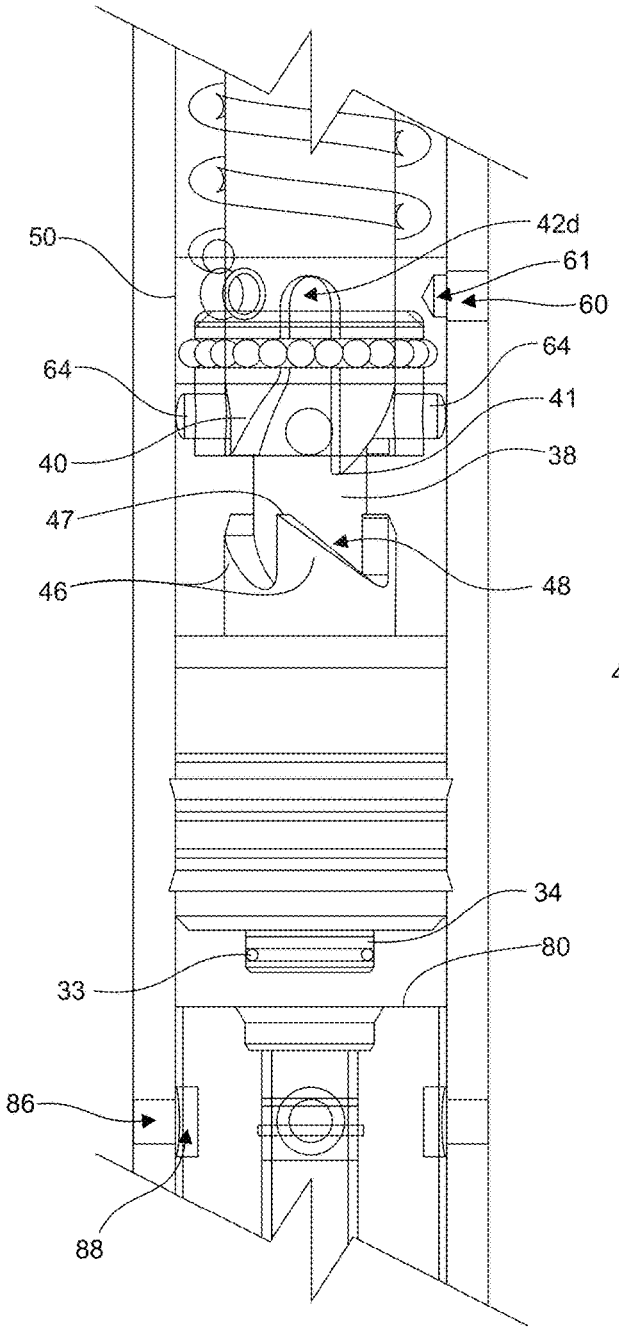
FIGS. 6A and 6B are cross sectional zoomed in side views of the present tool showing an example valve configuration in the first position depicted in FIG. 1 and in the second position depicted in FIG. 2, respectively.
Figure 6B:
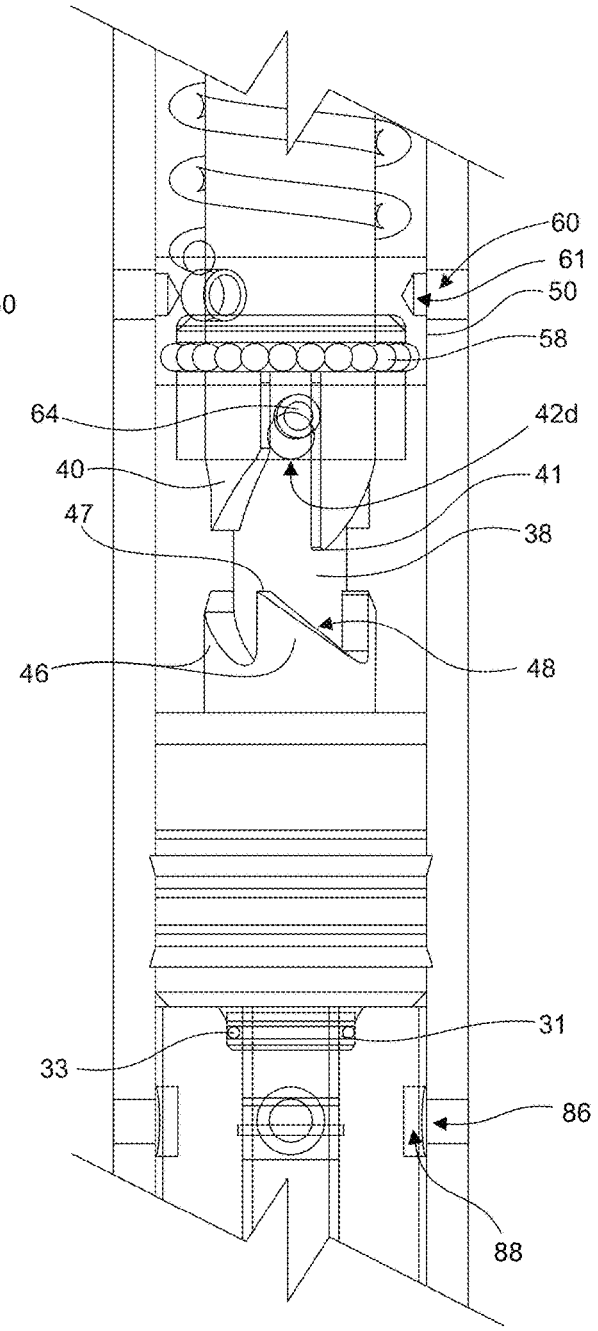

Tool 10 can be hydraulically-actuated between a first, low-pressure position (FIGS. 1 and 6A) and a second, high-pressure position (FIGS. 2 and 6B). In operation, tool 10 is positioned on a tool string substantially at or below the agitator tool operative to vibrate the string. Having regard to FIG. 1, drilling fluids are introduced to tool 10 via fluid inlet 13 and flow through bore 14 of housing 12, bore 22 of valve 20, bore 82 of valve seat 80, and exit tool 10 via fluid outlet 15. Depending on the position of valve 20, some of the drilling fluids may also flow through passages 84 before exiting fluid outlet 15. The position of valve 20 can be changed by repeated introduction of or increasing fluid flow through inlet 13. The repeated introduction or increase of fluid flow into tool 10 may exert enough force to compress spring 70, thereby displacing valve 20 axially downhole, whereas ceasing or decreasing fluid flow reduces the force exerted on spring 70, thereby releasing spring 70 and allowing valve 20 to revert axially uphole. Depending on the frequency and/or rate of the fluid flow into tool 10, valve 20 can be displaced axially downhole until valve plug 34 engages valve seat 80, thereby blocking fluid flow to passages 84 while all the fluids from bore 22 flow into and through bore 82 of valve seat 80. Valve 20 thus acts as a piston within tool 10. Accordingly, tool 10 is in the first, low-pressure position when drilling fluids flow through bore 82 and passages 84, and is in the second, high-pressure position when passages 84 are blocked and drilling fluids only flow through bore 82.

More specifically, having further regard to FIG. 6, as valve 20 moves axially downhole due to an introduction or increase in fluid flow into tool 10, upper teeth 40 descend downwardly, and due to their angled cam profiles, teeth 40 cause inner ring 52 to rotate as the teeth 40 engage cams 64 until cams 64 are received within slots 42*d* or slots 42*s*.

When cams 64 are received within the deeper slots 42*d*, tool 10 is in the second, high-pressure position, wherein valve 20 has been actuated downwardly and driven into valve seat 80 such that valve plug 34 forms a fluid-tight connection with bore 82 of valve seat 80. In the second, high-pressure position, spring 70 is energized as it is compressed between the upper portion 24 and bearing assembly 50. In the second, high-pressure position, the fluid flowing into tool 10 flows through bore 22 of valve 20 and then through bore 82 of valve seat 80, thereby generating a zone of high pressure in the tool string and coil tubing above tool 10. This resulting high pressure zone increases the pressure differential between the inside of the coil tubing and agitator uphole from tool 10, which may help the agitator operate more effectively while the tool string is travelling downhole.

When cams 64 are received within the shallower slots 42*s*, tool 10 is in the first, low-pressure position, wherein valve 20 is still driven down by the incoming fluid to energize spring 70, but fails to actuate downwardly far enough to sealingly engage valve seat 80. As such, in the first, low-pressure position, no fluid-tight connection is created between the valve plug 34 and bore 82 so fluid flowing into tool 10 flows through bore 22 of valve 20 and then through bore 82 and passages 84 of valve seat 80. As there is a greater rate of fluid flow past the valve seat 80, there is less pressure generated in the uphole tool string and coil tubing than in the second position. Advantageously, the pressure differential in the coil tubing and tool string is still high enough for the agitator to create the desired fluid hammer effect, as the motor creates the desired pressure differential in the coil tubing in place of the tool 10. Actuation of tool 10 into the first low-pressure position while running the motor is necessary; otherwise, the pressure in the coil tubing may be too high to run the motor.

To actuate tool 10 from the second high-pressure position to the first low-pressure position, and vice versa, fluid flow is first stopped or decreased such that valve 20 is spring-biased axially uphole by the release of potential energy of the energized spring 70. As the valve 20 moves axially uphole, cams 64 slide out of slots 42*d*,42*s* and meet the angled cam profiles of lower teeth 46, which causes inner ring 52 to rotate as cams 64 are received in valleys 48. Fluid flow into tool 10 is then started again or increased to drive valve 20 downhole, which also drives cams 64 into the angled cam profiles of upper teeth 40, thereby rotating inner ring 52 as cams 64 are received in the next set of slots 42*s*,42*d*. Since slots 42*s*,42*d* alternate between deep 42*d* and shallow 42*s* about the valve 20, if the cams 64 were previously received in the deep slots 42*d*, they will be received in the shallow slots 42*s* when the tool is re-actuated, and vice versa. In this manner, fluid flow into tool 10 can be stopped or decreased and then started or increased to actuate valve 20 and rotate inner ring 52 until the cams 64 are received in the desired slots 42*s*,42*d* to accordingly place tool 10 in the desired operating position.

In some embodiments, housing 12 may include radial ports (not shown) above and proximate to the valve seat 80 in addition to, or as an alternative to, passages 84. When the tool 10 is in the second high-pressure position, valve 20 fluidly seals the radial ports to prevent fluid communication between bore 14 of housing 12 and the annulus. When tool 10 is in the first low-pressure position, fluid in the tool 10 flows into the annulus via the radial ports as well as downhole through bore 82 and outlet 15. The radial ports, bore 82, and passages 84 may be individually or collectively referred to herein as flow passages.

A tool 100 according to another embodiment is shown in FIG. 9. Reference numerals of the components in FIG. 9 are the same as assigned for like components of tool 10 and new reference numerals are provided for differing components. Tool 100 has a valve seat 180 that is different from the valve seat 80 of tool 10. Valve seat 180 has a through bore 82 and, in lieu of radial passages 84, valve seat 180 has one or more side bores 184 each in fluid communication with the outer surface of housing 12 via a radial port 190 provided in the wall of housing 12. Side bores 184 and radial ports 190 may be individually or collectively referred to herein as flow passages.

Figure 9A:
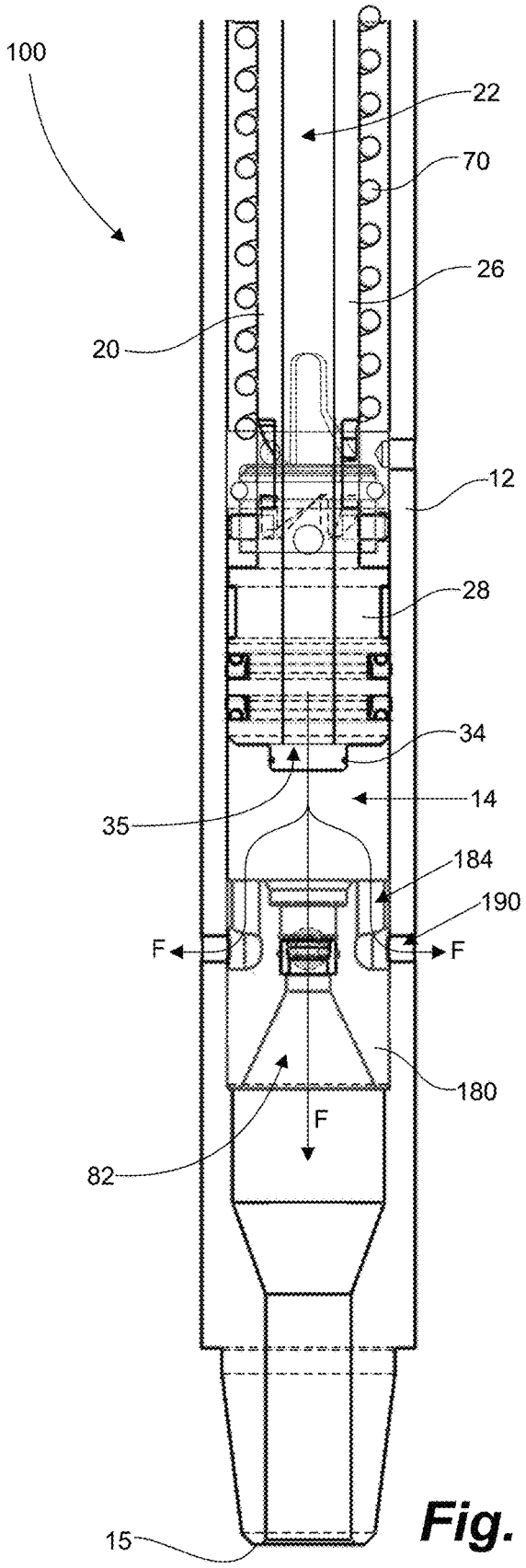
FIGS. 9A and 9B are cross sectional zoomed in side views of the present tool according to another embodiment herein, the tool shown in a first (low pressure) position and a second (high pressure) position, respectively.

FIG. 9A illustrates the tool 100 in a first low-pressure position wherein fluid in bore 22 exits valve 20 at plug bore 35 and flows into the annulus via the one or more side bores 184 and radial ports 190, respectively, as well as downhole through bore 82 of seat valve 180 and outlet 15. In FIG. 9A, the flow path of the fluid in the first low-pressure position is denoted by the reference character F.

Figure 9B:
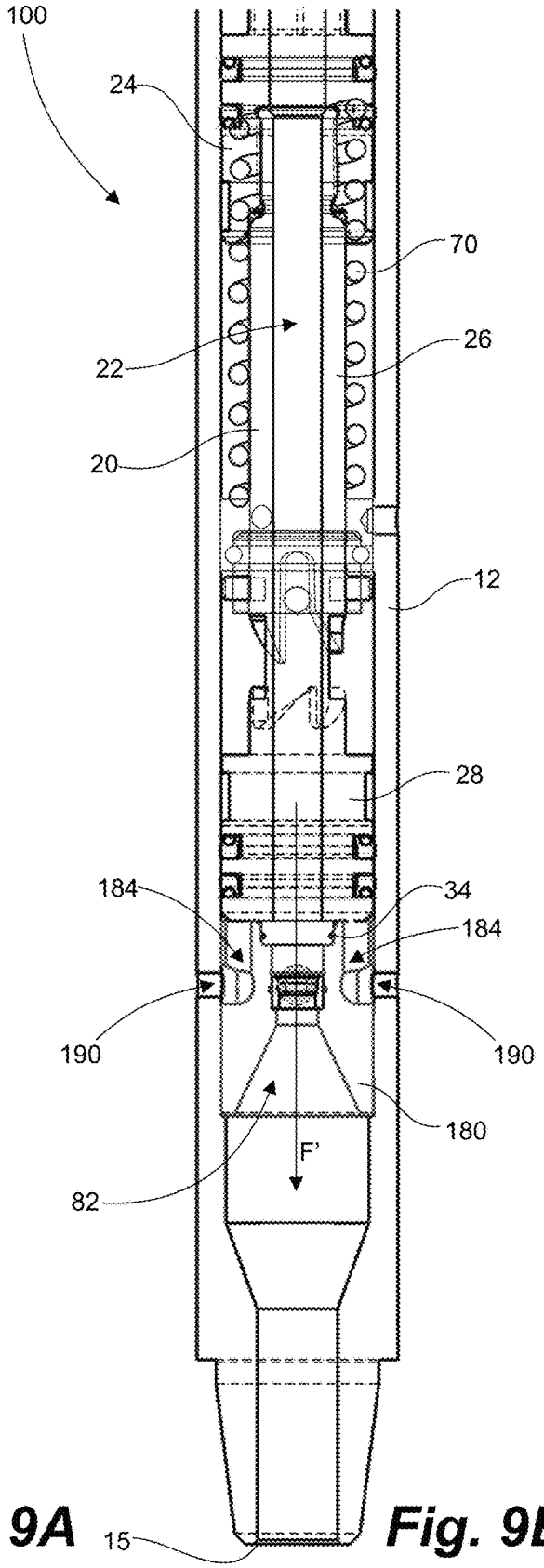

FIG. 9B illustrates the tool 100 in a second high-pressure position wherein valve 20 is shifted down to engage seat valve 180, thereby blocking the side bores 184 to prevent any fluid in tool 100 from entering the annulus via radial ports 190. In the second high-pressure position, all the fluid flow is directed downhole through bore 82 and outlet 15, respectively. In FIG. 9B, the flow path of the fluid in the second high-pressure position is denoted by the reference character F'. It can be appreciated that tool 100 can be transitioned between the first low-pressure position and the second high-pressure position in the manner described above with respect to tool 10.

In some embodiments, the tool may be configured to block all or substantially all fluid from flowing downhole in one of the two positions. For example, a tool 200 shown in FIG. 10 has two positions—a first bypass position and a second flow-through position. Reference numerals of the components in FIG. 10 are the same as assigned for like components of tool 10, 100 and new reference numerals are provided for differing components. In the bypass position, all or substantially all fluid in the tool 200 is directed to the annulus, thereby restricting fluid flow downhole, for example, to the motor. In the flow-through position, substantially all or some of the fluid in the tool can flow downhole via outlet 15.

In a sample embodiment, tool 200 includes a valve seat plug 282 for restricting fluid flow through the bore 82 of valve seat 180 when the tool 200 is in the first bypass position. Plug 282 has an elongated body, and an inner bore 283 defined in the body extending between an upper open end 284 and a lower closed end 286. Plug 282 also has one or more radial exit ports 288 defined at an axial location of the body between ends 284, 286 to allow fluid communication between the inner bore and the outer surface of the plug 282. The open end 284 is connected to the downhole end of valve 20 such that inner bore 283 and exit ports 288 are in fluid communication with bore 22. The body of plug 282 extends downwardly from the valve 20 into bore 82 of seat valve 180 and is slidably movable in bore 82 as the tool 200 transitions between positions. Plug 282 is configured to form a seal in bore 82 of the seat valve 180 when the tool 200 is in the bypass position to restrict fluid flow downhole. In the illustrated embodiment, the lower closed end 286 is enlarged and is shaped (e.g. frustoconically shaped) for matingly plugging the bore 82 at or near the downhole end. Ports 288 are located on the body of plug 282 such that they are in fluid communication with ports 190 via bore 14 and side bores 184 when the tool 200 is in the bypass position and with bore 82 of the seat valve 180 when the tool 200 is in the flow-through position.

Figure 10A:
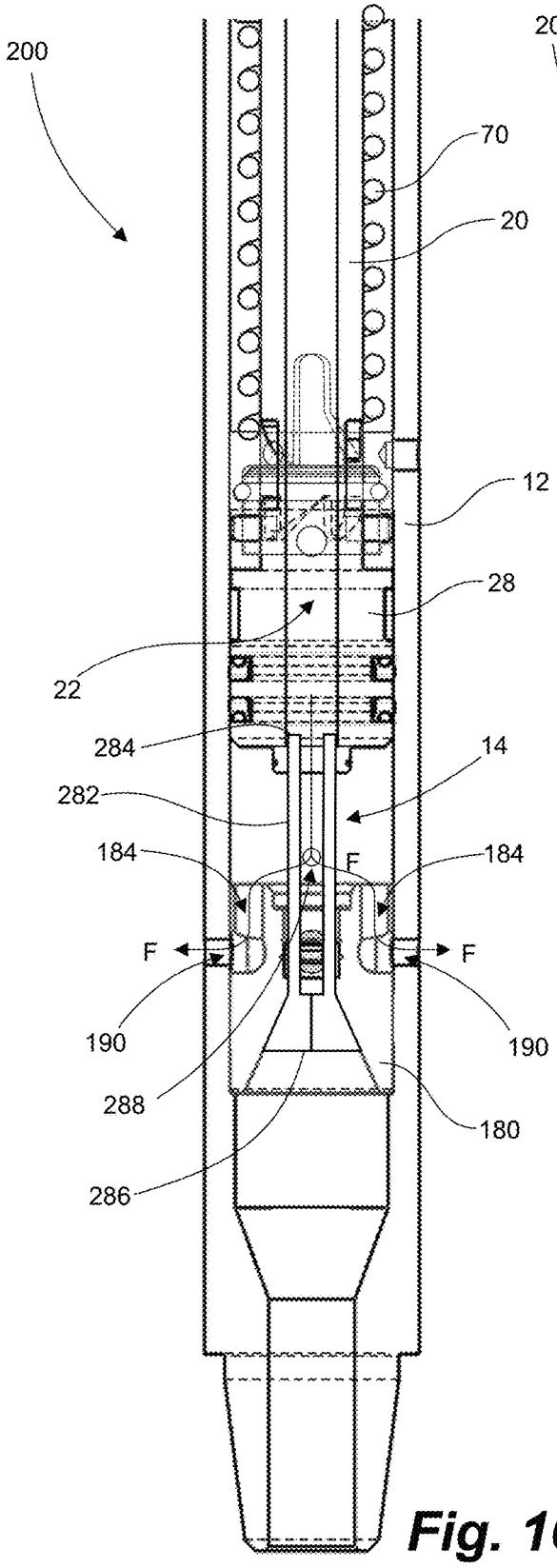
FIGS. 10A and 10B are cross sectional zoomed in side views of the present tool according to yet another embodiment herein, the tool shown in a first bypass position and a second flow-through position, respectively.

FIG. 10A illustrates the tool 200 in the bypass position wherein valve 20 is spaced apart from seat valve 180 such that lower end 286 of plug 282 engages the seat valve 180 to plug bore 82. Accordingly, in the bypass position, all or substantially all the fluid in bore 22 of valve 20 flows into the annulus via bore 283, ports 288, side bores 184, and ports 190, respectively. In FIG. 10A, the flow path of the fluid in the first bypass position is denoted by the reference character F.

Figure 10B:
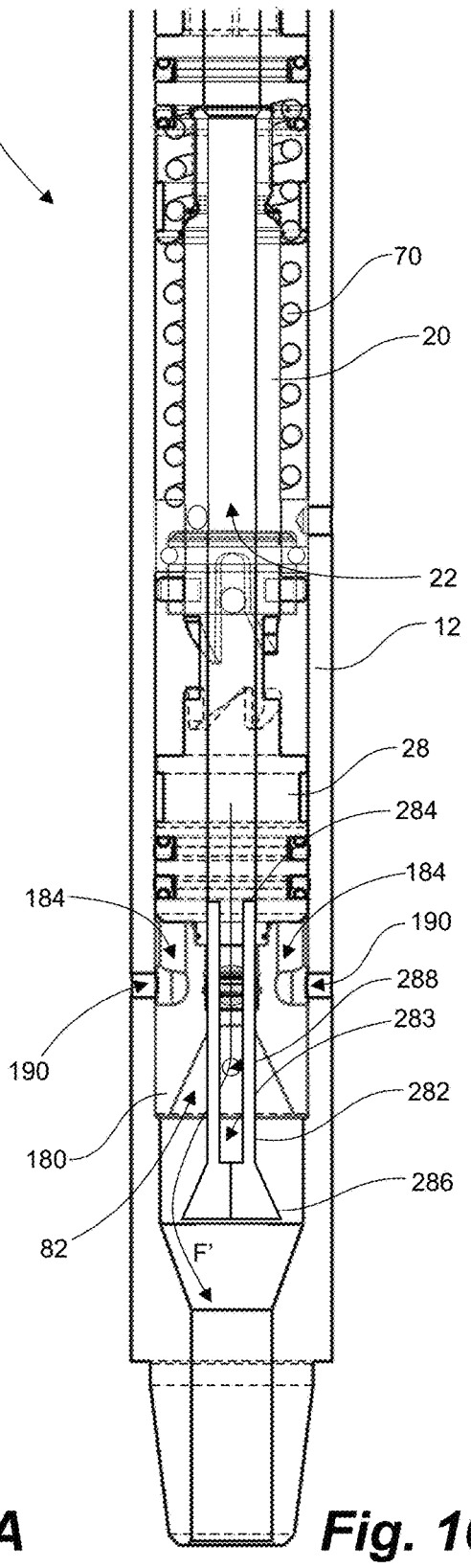

FIG. 10B illustrates the tool 200 in the second flow-through position wherein valve 20 is shifted down to (i) disengage lower end 286 of plug 282 from seat valve 180, thereby allowing fluid communication between inner bore 283 and outlet 15 via ports 288; and (ii) engage the seat valve 180, thereby blocking the side bores 184 and cutting fluid communication between ports 288 and bores 184 to prevent any fluid in tool 200 from entering the annulus via radial ports 190. In the flow-through position, all the fluid flow in bore 22 is directed downhole through bore 283, ports 288, and outlet 15, respectively. In FIG. 10B, the flow path of the fluid in the second flow-through position is denoted by the reference character F'.

In other words, in the first position, all or substantially all of the fluids entering the tool 200 are directed to flow through side bores 184 and ports 190 before exiting into the annulus, and in the second position, all or substantially all of the fluids entering the tool 200 are redirected to flow through bore 82 of the seat valve 180 before exiting the tool via outlet 15.

The use of plug 282 is only one way of restricting and/or directing fluid flow downhole in the bypass position of tool 200. It can be appreciated that other ways of restricting fluid flow downhole in the bypass position are possible. It can also be appreciated that tool 200 can be transitioned between the bypass position and the flow-through position in the manner described above with respect to tool 10. Accordingly, tool 200 allows the all or substantially all of the fluid therein to be selectively directed to the annulus or downhole. Tool 200 may be useful in situations where it may be desirable to have the fluid in the tool bypass the motor and/or drill bit downhole (e.g. to over circulating the drilling fluids to prevent damage to the motor) or to have substantially all the fluid flow into the annulus (e.g. for flushing out the annulus to remove debris or cuttings). As would be known, tool 10, 100, 200 may be manufactured from any suitable materials known in the art, including from 4145 alloy steel. In some embodiments, valve 20 and bearing assembly 50 can be made of conventional steel or other suitable materials. Cams 64 can be of a material of slightly dissimilar hardness than that of valve 20 to avoid galling when interacting with the upper or lower teeth 40,46.

Accordingly, a downhole tool 10, 100, 200 for use in wellbore operations is provided herein. The tool enhances the agitation of downhole tools during operations such as milling operations within the wellbore, thereby expediting the operations. In some embodiments, the tool 10 has a first low-pressure position wherein fluids entering the tool flow through two or more flow passages in the tool before exiting the tool and a second high-pressure position wherein at least one of the two or more flow passages is blocked such that all or substantially all fluids entering the tool flow through the remaining unblocked flow passages before exiting. In other embodiments, the tool 200 has two or more flow passages therein; has a first bypass position wherein at least one of the two or more flow passages is blocked such that all or substantially all fluids entering the tool flow through the remaining unblocked flow passages; and has a second flow-through position wherein the previously blocked flow passages are unblocked and the previously unblocked flow passages are blocked such that all or substantially all fluids entering the tool flow through the now unblocked flow passages.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

What is claimed is:

1. A tool connectable to a tubing string for enhancing agitation of a downhole apparatus, the tool comprising:

a housing having an axial bore extending therethrough between a housing inlet and a housing outlet, and two or more flow passages defined therein uphole from the housing outlet; and a piston movable in the bore of the housing between a first position and a second position, the piston having an axial bore extending therethrough between a piston inlet and a piston outlet, the piston inlet being in fluid communication with the bore of the housing, and in the first position, the bore of the piston is in fluid communication with the two or more flow passages via the piston outlet; and in the second position, the piston blocks fluid communication to at least one of the two or more flow passages, and the bore of the piston is only in fluid communication with the remainder of the two or more flow passages via the piston outlet, wherein the piston is transitionable between the first and second positions by alternately introducing or increasing fluid flow to the housing via the housing inlet and ceasing or decreasing the fluid flow to the housing via the housing inlet, and wherein the fluid flow flows through at least some of the flow passages before exiting the tool, wherein the piston comprises an elongated body having an upper portion connected to a lower portion by a middle portion; and a spring supported on the outer surface of the middle portion, wherein the upper and lower portions are in sealing engagement with the inner surface of the housing, and a bearing assembly secured to and inside the housing, and wherein the piston further comprises a cam actuation area between the spring and the lower portion, and the bearing assembly abutting the lower end of the spring and being in rotational engagement with the piston about the cam actuation area.

2. The tool of claim 1, wherein the cam actuation area comprises a plurality of radially intermittently positioned upper teeth separated by alternating deep and shallow slots, and a plurality of radially intermittently positioned lower teeth separated by valleys, and the bearing assembly comprises a cam for engaging the plurality of upper and lower teeth, slots, and valleys, or vice versa.

3. The tool of claim 2, wherein when the spring is compressed, the cam is received in one of the deep or shallow slots; and when the spring is released, the cam is received in one of the valleys.

4. The tool of claim 3, wherein the plurality of upper and lower teeth have cam profiles such that the cam is moved to the next slot or valley upon each compression and release of the spring.

5. The tool of claim 3, wherein when the cam is received in the shallow slot, the piston is in the first position; and when the cam is received in the deep slot, the piston is in the second position.

6. The tool of claim 1, further comprising a valve seat secured to and inside the housing, uphole from the housing outlet, and at least one of the two or more flow passages is provided in the valve seat.

7. The tool of claim 6, wherein the valve seat has an axial bore extending therethrough and one or both of: (i) the valve seat has one or more axial passages formed on its outer surface, extending from one end of the valve seat to the other end, and (ii) the housing has one or more radial ports uphole from the valve seat, and wherein the bore and the plurality of the passages of the valve seat are in fluid communication with the housing outlet, and the two or more flow passages comprises the bore of the valve seat and the one or more axial passages of the valve seat and/or the one or more radial ports.

8. The tool of claim 7, wherein when the piston is in the second position, the piston outlet is in fluid communication with the bore of the valve seat and the piston blocks fluid communication to the one or more axial passages of the valve seat and/or the one or more radial ports.

9. The tool of claim 7, wherein the axial bore of the valve seat has a frustoconically shaped lower end.

10. A method of enhancing agitation of a downhole apparatus on a tubing string, the method comprising:

providing a tool on the tubing string, the tool comprising a housing having an axial bore extending between a housing inlet and a housing outlet and two or more flow passages defined therein; and a piston movable in the housing between a first position and a second position, the piston having an axial bore between a piston inlet and a piston outlet, the piston inlet being in fluid communication with the bore of the housing;

introducing or increasing fluid flow to the housing via the housing inlet to move the piston axially in a direction to place the piston in the first or second position, wherein in the first position, the bore of the piston is in fluid communication with the two or more flow passages via the piston outlet; and in the second position, the piston blocks fluid communication to at least one of the two or more flow passages, and the bore of the piston is only in fluid communication with the remainder of the two or more flow passages via the piston outlet;

ceasing or decreasing the fluid flow to the housing to move the piston axially in a second direction opposite to a first direction;

introducing or increasing the fluid flow to the housing via the housing inlet to move the piston axially to transition the piston from the first position to the second position or from the second position to the first position; and wherein the piston has a spring supported thereon, and wherein the housing further comprises a bearing assembly secured therein, the bearing assembly being rotatable about the piston and the spring abuts the upper end of the bearing assembly, and wherein introducing or increasing the fluid flow to the housing compresses the spring against the bearing assembly and ceasing or decreasing the fluid flow to the housing releases the spring.

11. The method of claim 10, wherein the piston has defined thereon a plurality of radially spaced apart upper teeth separated by alternating deep and shallow slots, and a plurality of radially spaced apart lower teeth separated by valleys, and the bearing assembly comprises a cam for engaging the plurality of upper and lower teeth, slots, and valleys, or vice versa.

12. The method of claim 11, wherein introducing or increasing the fluid flow to the housing moves the cam into one of the deep or shallow slots; and ceasing or decreasing the fluid flow to the housing moves the came into one of the valleys.

13. The method of claim 12, wherein the plurality of upper and lower teeth have cam profiles such that the cam is moved to the next slot or valley upon each introduction or increase and cessation or decrease of the fluid flow to the housing.

14. The method of claim 12, wherein when the cam is received in the shallow slot, the piston is in the first position; and when the cam is received in the deep slot, the piston is in the second position.

15. The method of claim 10, wherein the housing further comprises a valve seat secured to and inside the housing, uphole from the housing outlet, and at least one of the two or more flow passages is provided in the valve seat.

16. The method of claim 15, wherein the valve seat has an axial bore extending therethrough and one or both of: (i) the valve seat has one or more axial passages formed on its outer surface, extending from one end of the valve seat to the other end, and (ii) the housing has one or more radial ports uphole from the valve seat; and wherein the bore and the plurality of the passages of the valve seat are in fluid communication with the housing outlet, and the two or more flow passages comprises the bore of the valve seat and the one or more axial passages of the valve seat and/or the one or more radial ports.

17. The method of claim 16, wherein when the piston is in the second position, the piston outlet is in fluid communication with the bore of the valve seat and the piston blocks fluid communication to the one or more axial passages of the valve seat and/or the one or more radial ports.

* * * * *